United States Patent [19]

Graham et al.

[11] 4,225,396

[45] Sep. 30, 1980

[54] VANADIUM AND URANIUM OXIDATION BY CONTROLLED POTENTIAL ELECTROLYSIS

[75] Inventors: Paul R. Graham, Edmond; Olen L. Riggs, Jr., Bethany, both of Okla.

[73] Assignee: Kerr-McGee Corporation, Oklahoma City, Okla.

[21] Appl. No.: 949,976

[22] Filed: Oct. 10, 1978

[51] Int. Cl.[2] ..... C25C 1/22

[52] U.S. Cl. ..... 204/1.5; 204/105 R; 204/195 F; 204/257

[58] Field of Search ..... 204/1.5, 59 M, 195 F, 204/257, 105 R

[56] References Cited

U.S. PATENT DOCUMENTS

| | | | |
|---|---|---|---|
| 2,288,752 | 7/1942 | Simpson | 204/90 |
| 3,479,139 | 11/1969 | Koerner | 423/321 R |
| 3,836,476 | 9/1974 | Baldwin et al. | 252/301.1 R |
| 4,056,458 | 11/1977 | Pohto et al. | 204/257 |
| 4,129,481 | 12/1978 | Aubert et al. | 204/1.5 |

FOREIGN PATENT DOCUMENTS

| | | | |
|---|---|---|---|
| 2065652 | 8/1971 | France | 204/1.5 |

*Primary Examiner*—Leland A. Sebastian
*Attorney, Agent, or Firm*—William G. Addison

[57] ABSTRACT

A process and apparatus for oxidizing vanadium and uranium in wet process phosphoric acid to a higher valence state for extraction by subsequent contact with complex organic extractants. The wet process phosphoric acid is oxidized in an electrolytic cell operated at a controlled potential via use of a reference electrode. The cell comprises a tank having at least one high surface area anode and at least one high surface area cathode separated by an ion exchange membrane.

10 Claims, 4 Drawing Figures

VANADIUM AND URANIUM OXIDATION BY CONTROLLED POTENTIAL ELECTROLYSIS

BACKGROUND OF THE INVENTION

1. Field of the Invention

This invention relates to a process for oxidizing the vanadium and uranium contained in wet process phosphoric acid to a higher valence state for extraction by subsequent contact with complex organic extractants. This invention further relates to an electrolytic cell in which to practice the process. The cell is capable of operating at relatively high current efficiency over extended periods of time with little or no maintenance.

2. Description of the Prior Art

Phosphoric acid is generally produced commercially by one of two methods. One method is generally called the "furnace" method, and the other is generally referred to as the "wet process" method. In the wet process method of producing phosphoric acid, phosphate rock is contacted with a mineral acid such as sulfuric acid. Most phosphate rock contains metal compounds in varying amounts. In many cases, these metal compounds are dissolved from the phosphate rock and appear in the wet process acid as contaminants. Vanadium and uranium compounds are among those dissolved from the phosphate rock, particularly when the rock is from the so-called western deposits of Idaho, Wyoming, Utah and Montana.

Vanadium, however, is an undesirable component of wet process phosphoric acid in that it prevents the use of the phosphoric acid in making animal feed supplements, as the amount of vanadium must be kept at a low level in such animal feed supplements. Similarly, uranium is undesirable in such feed supplements. Further, the removal of these uranium values from wet process phosphoric acid would prevent their release to the environment via the widespread usage of the fertilizer end products.

On the other hand, vanadium and uranium are valuable materials and wet process phosphoric acid can be an important source of these materials. Therefore, a process for the recovery of vanadium and uranium from wet process phosphoric acid provides an important benefit in that the vanadium and uranium are converted from undesirable contaminants to valuable by-products.

There are processes for the simultaneous coextraction of vanadium and uranium from aqueous acidic solutions containing the same, such as for example the process disclosed by U.S. Pat. No. 3,836,476. There also are numerous processes for the recovery of vanadium or uranium separately from wet process acids.

In the coextraction processes and many of the other processes, it is necessary to oxidize the vanadium and uranium to a higher valence level to enable the vandium and uranium to be separated.

In the past, this oxidation has been achieved through the addition of chemical oxidants in an amount in excess of the stoichiometric requirement for oxidizing all the vanadium to vanadium (V) and all the uranium to uranium (VI). Normally, the oxidant is added in an amount of from about 50 percent to 1000 percent in excess of that which is stoichiometrically required. Various oxidizing agents have been used such as chlorates, manganese dioxide, permanganates, dichromates, peroxydisulfates, and ceric salts.

The disadvantages resulting from chemical oxidation are increased process expense, the possibility of increased plant corrosion, and further contamination of the acid through addition of the oxidizing agent.

Though while not applied to the oxidation of vanadium and uranium, it is known that phosphoric acid containing trivalent iron impurities can be purified by direct current electrolytic reduction of the iron to the divalent oxidation state and precipitation of the iron impurities by the process disclosed in U.S. Pat. No. 2,288,752, or by direct current electrolytic reduction of the iron impurities and recovery of the phosphoric acid by extraction with a water-insoluble amine extractant, such as, disclosed in U.S. Pat. No. 3,479,139.

The principal disadvantage of these reduction processes is that they operate by passing a constant direct current through the phosphoric acid electrolyte to purify the material. Thus, the prior processes do not provide a means of controlling the electrolysis, resulting in decreased current efficiency and thereby increased operating expenses.

It is desirable to provide a process whereby vanadium and uranium may be oxidized automatically by electrolytic means with improved current efficiency.

SUMMARY OF THE INVENTION

The discovery now has been made that vanadium, uranium, iron and other metals present in wet process phosphoric acid can be efficiently oxidized through electrolytic oxidation by potentiostatic techniques. The process of the present invention provides for the automatic control of the anode reference potential most suited to the oxidation reaction as referenced to a standard half-cell so that the preferred, most efficient oxidation of uranium and vanadium can be achieved.

The present invention further provides a compact electrolytic cell which is capable of operating in a continuous manner at high current efficiency over extended periods of time. This cell has a relatively low operating cost due, in part, to the prolonged life of the electrodes, which results in substantial reductions in electrode material costs and maintenance costs.

Broadly, the electrolytic cell of this invention comprises a tank having an open top and a closed bottom. A plurality of vertically arranged high surface area anodes and a plurality of high surface area vertically disposed, substantially parallel cathodes are mounted within the cell. The anodes and cathodes are separated by a plurality of ion exchange membranes such that separate anolyte and catholyte compartments are created. In one embodiment, the anodes and cathodes are secured and the electrical connections are made through the base of the electrolytic cell. In an alternate embodiment the anodes and cathodes are secured and connections are made through a side wall of the cell. The anolyte and catholyte enter their respective compartments through the base of each compartment and exit through outlets in a side wall of the cell to maintain a constant electrolyte volume within the compartments. The electrodes are mounted in the cell in such a manner that they are completely submerged within the respective electrolytes to maximize the electrode surface area available to the electrolyte. In yet another embodiment, the electrolytic cell is provided with a cover including an evolved gas exit port to seal the top of the tank from the surrounding environment.

In continuous processes, a plurality of electrolytic cells can be arranged such that the anolyte and catholyte from each cell flow continuously by either parallel or countercurrent flow to successive cells arranged in either series or parallel configurations.

DESCRIPTION OF THE PREFERRED EMBODIMENTS

Figure 1:
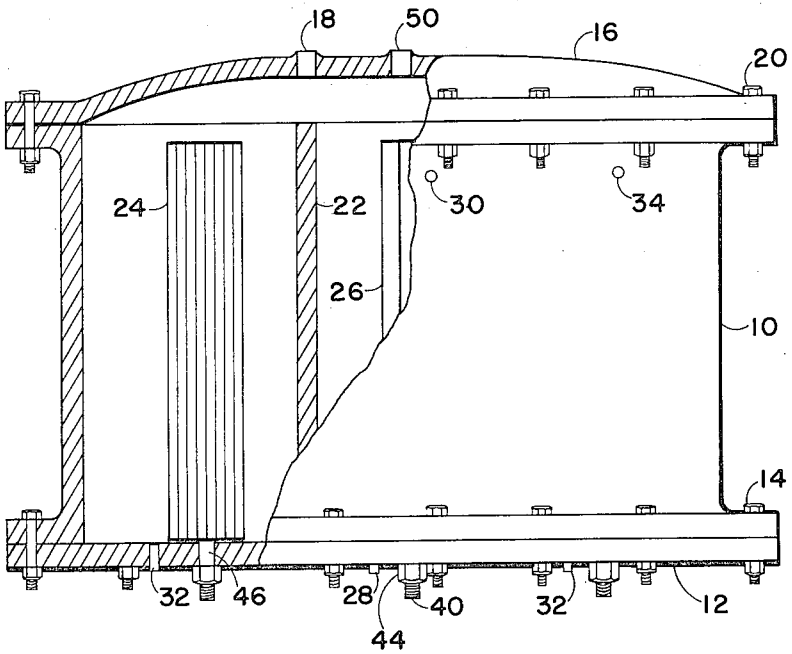
FIG. 1 is a view partly in elevation and partly in section of an embodiment of the electrolytic cell of this invention.

Turning now to FIG. 1, there is illustrated the electrolytic cell of this invention which comprises a tank 10 having a closed bottom 12 and an open top. The cell bottom 12 can be integral with the tank or may be removably secured thereto by suitable means, such as bolts 14. Alternatively, the tank can be provided with a top 16 provided with an evolved gas discharge port 18. The cell top 16 also can be removably secured to the tank by suitable means, such as bolts 20.

The tank 10 preferably is formed of an electrically non-conductive, corrosion resistant material. Preferably the tank is formed of a material such as polyvinyl chloride, polyvinyl dichloride, polyvinyl difluoride, natural or synthetic rubber, polyester resins, phenolic resins and the like.

The top 16 is also formed of an electrically non-conductive, corrosion resistant material which may be the same as, or different from, the material of which tank 10 is formed.

A plurality of ion exchange membranes 22 are located within tank 10 to divide the tank into a number of individual compartments for containing the individual cathodes 24 and anodes 26 and their respective catholyte and anolyte solutions. The membranes comprise a prepared cloth material which is mounted in a friction-fit frame. The frame then is mounted within the tank 10 by insertion into suitable guides or grooves (not shown) in the walls of the tank 10 such that the tank is divided into individual compartments. The following criteria were used in selecting membrane materials. The material must:

(a) demonstate an electrolyte leakage rate of less than 5 percent;

(b) provide no detrimental addition to the cell voltage;

(c) provide a low resistivity so as not to restrict cell conductivity; and (d) be durable, easily replaced and cleaned.

As a result of testing it was determined that two basic forms of ion exchange membrane provide the desired low leakage rate, no measurable addition to cell voltage, low resistivity and durability. In one form, the membrane is comprised of two sheets of DYNEL® modacrylic fiber cloth, produced by Union Carbide Corporation, New York, New York which are sealed together with a coating of KYNAR® latex, a polyvinylidene fluoride homopolymer, produced by Penwalt Corporation, Plastics Dept., Philadelphia, Pa. In the second form, the membrane is comprised of two sheets of DYNEL® modacrylic fiber cloth which sandwich a stiff gelatinous mass comprising a 3 normal sulfuric acid solution containing 20 weight percent sodium silicate which is produced by dissolving the sodium silicate in the sulfuric acid solution at an elevated temperature and then cooling the mixture.

The anolyte solution utilized in this cell comprises a wet process phosphoric acid (hereafter referred to as WPA) containing uranium and vanadium. The anolyte is introduced into the anode compartment via an anolyte entrance port 28 located on the bottom 12 of tank 10 by, for example, pumping or gravity regulated flow. The anolyte is withdrawn from the cell via passage through an anolyte exit port 30 located on the side wall of tank 10. The exit port 30 is located such that the anode within the compartment is completely covered by the anolyte.

The catholyte solution utilized in this cell comprises a raffinate solution resulting from the stripping of the oxidized anolyte by contacting it with a complex organic extractant to recover vanadium and uranium therefrom. It is possible to utilize other catholyte solutions, however, it is preferable to employ the raffinate solution as this results in reducing the acid solution such that it is returned to substantially the same electrochemical potential as the WPA before it was treated to facilitate the uranium and vanadium recovery. The catholyte is introduced into the cathode compartment via a catholyte entrance port 32 located on the bottom 12 of tank 10. The catholyte is withdrawn from the cell via a catholyte exit port 34 located similarly to the anolyte exit port 30.

The anodes 26 employed in this cell are specially designed high surface area anodes which require a minimum of current to maintain a selected voltage potential between the anode and a reference electrode in the anolyte. To select suitable anode materials, anodic polarization tests were conducted upon various electrode materials. It has been determined that to satisfactorily oxidize the anolyte to facilitate removal of the uranium and vanadium it is necessary to control the voltage potential between the anode and a discretely mounted reference electrode in a range of from about +1200 to +1600 millivolts (+1200–+1600 $E_{mv}$) with respect to the reference electrode and preferably in a range from about +1350 to about +1450 millivolts for a period of time sufficient to oxidize the anolyte (WPA) to an EMF of at least +900 millivolts as measured with a standard calomel electrode, and preferably to an EMF of more than +1050. An optimum degree of oxidization is from about +950 to about +1100 millivolts. Thus, the preferred anode materials are those which require the minimum current to maintain the selected voltage potential. The results of various anodic polarization tests utilizing various anode materials are set forth in the Table below:

TABLE

| Prospective Anode Material | Current Required To Achieve +1200-+1600 $E_{mv}$ SCE, ma | Current Required To Maintain +1400 $E_{mv}$ SCE, ma |
|---|---|---|
| Graphite | 100-320 | 210 |
| Jessops #9 | 35-103 | 70 |
| Platinum | 20-40 | 26 |
| Inconel 625 | 205-900 | 540 |
| Vanadium | 300-450 | 380 |
| Armco NP 444 | 200-850 | 520 |
| Armco 22-13-5 | 220-900 | 560 |
| Ebrite 26-1 | 260-1350 | 800 |
| WSS 18-18-2 | 275-1200 | 740 |
| Hastalloy C | 300-1050 | 660 |
| WSS Tenelon | *10 amps at | *10 amps at |

TABLE-continued

| Prospective Anode Material | Current Required To Achieve +1200-+1600 $E_{mv}$ SCE, ma | Current Required To Maintain +1400 $E_{mv}$ SCE, ma |
|---|---|---|
| Titanium | +1160 $E_{mv}$ SCE passive | +1160 $E_{mv}$ SCE passive |

*Maximum current available from test equipment employed.

These results clearly demonstrate that a platinum electrode is greatly superior and thus preferred to other anode materials. Other suitable electrodes would comprise a metal substrate coated with a nobel metal such as platinum, platinum-iridium, ruthenium or the like. The metal substrate may be selected from the group consisting of titanium and its alloys, zirconium, tantalum, niobium, hafnium and their alloys.

Figure 2:
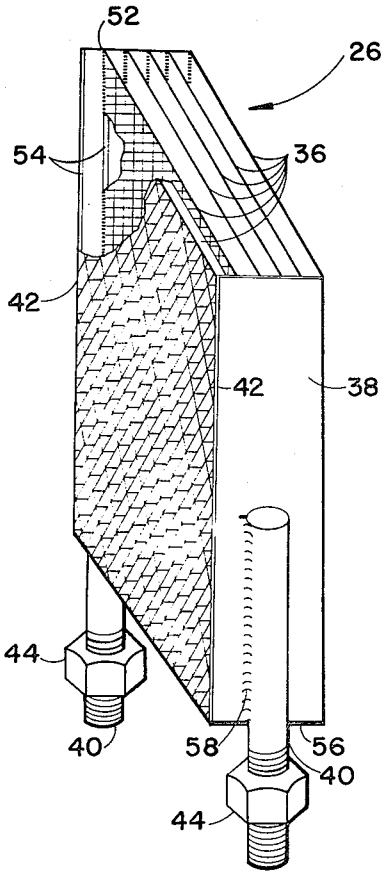
FIG. 2 is a detailed view of one anode for use in the electrolytic cell of this invention.

The anode 26 is constructed as illustrated in FIG. 2. The anode 26 comprises a plurality of expanded metal sheets, wire mesh, or perforated sheets and the like panels 36 which are engaged on two parallel edges 42 by metal strips 38 to provide a frame. The metal strips 38 are provided on one side with a plurality of parallel channels or grooves 54 running perpendicularly to the edge 56 of the strip 38 spaced equidistantly across the surface of one side. The channels 54 are of such a dimension that the parallel edges 42 of panels 36 can be slidably engaged therein upon insertion into said channels. The channels 54 provide a means by which the panels 36 can be maintained in a fixed relationship with respect to one another such that the surface of one panel 36 is equidistant from the surface of the next consecutive panel 36. After insertion of the edges 42 into channels 54 of metal strips 38, such that a parallel configuration results, the panels 36 are fixedly secured in the channel 54 by for example welds 52 or any other suitable means of attachment. Two copper cored metal rods 40 are positioned upon the unchanneled side of metal strips 38 such that a portion of the rod projects beyond the edge 56 of strip 38 to provide a means for mounting the anode 26. The rods 40 are fixedly secured to the metal strips 38 by for example welds 58. The projecting ends of rods 40 are provided with standard threading for attachment of nuts such that the anode 26 can be securely mounted within the cell with mounting nuts 44. The projecting ends further provide the means for achieving electrical contact with the anode within the cell to complete the electrolytic circuit. Most preferably, the anode is constructed of expanded titanium which then is coated with a nobel metal coating.

The use of expanded metal materials enables a high surface area anode to be constructed in a minimum of space such that an anode having a surface area to anolyte volume ratio in excess of 20 $ft^2$/gal of anolyte can be prepared. Preferably, an anode having a ratio in excess of 25 $ft^2$/gal. of anolyte is prepared. This results in improved operating efficiency of the cell.

The cathodes 24 are constructed similarly to the anodes 26 illustrated in FIG. 2. The cathodes however do not require a noble metal coating or the use of copper cored mounting rods. Suitable cathode construction materials include stainless steels, steel alloys and the like. This construction provides a high surface area cathode having a ratio of cathode surface area to catholyte volume in excess of 20 $ft^2$/gal. of catholyte for reducing the raffinate and decreasing the operating cell voltage.

The anode and cathodes are mounted by passing the respective mounting rods 40 through passages 46 (FIG. 1) located on the bottom 12 in each compartment formed by membranes 22 in tank 10 and securely affixing the mounting nuts 44 upon the extending threaded rods.

Figure 3:
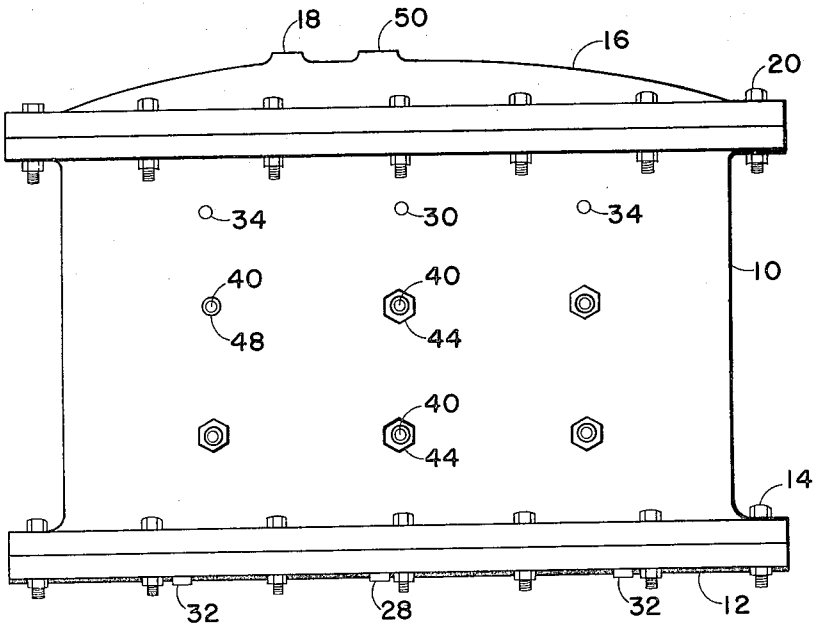
FIG. 3 is a view, of an alternate embodiment of the electrolytic cell of this invention.

Turning now to FIG. 3, an alternate embodiment of the cell is illustrated. In this embodiment, the anode and cathode mounting rods 40 extend through passages 48 in one side wall of tank 10.

A reference electrode is mounted in the anode compartment created by the membranes 22 via a passage 50 located in top 16 of tank 10. The reference electrode is mounted in close proximity to the anode and positioned such that it is capable of monitoring the average voltage potential between the anode and the reference electrode.

Figure 4:
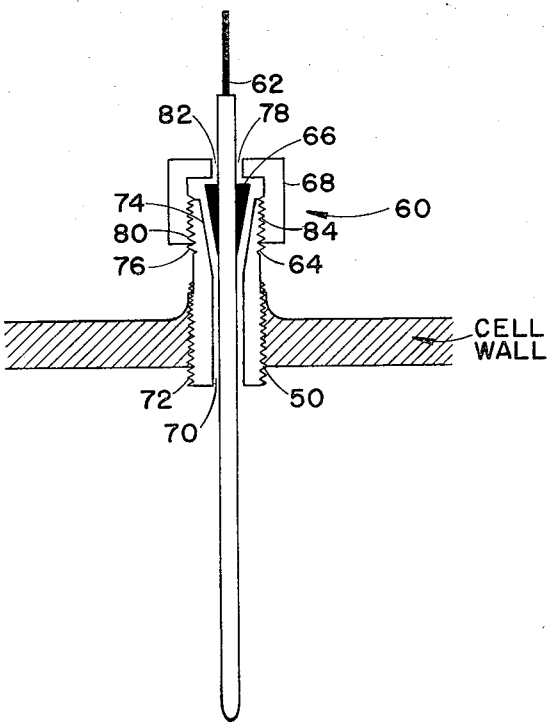
FIG. 4 is a partially exploded cross-sectional view of a reference electrode and mounting means for use in the electrolytic cell of this invention.

Potentiostatic techniques require a durable, responsive reference electrode which will provide a constant, stable voltage. Although conventional electrodes provide constant, stable voltage, they can be very expensive and are not sufficiently durable for use in commercial operations due to extreme fragility, potential for accidental contamination, plugging and the like. Thus, it was necessary to develop a new, novel and unique reference electrode which would be durable and remain responsive to the reference voltage being potentiostaticly controlled. The reference electrode developed for use in the cell of this invention comprises crystalline silver chloride which is melted and poured around a silver wire or rod contained in a mold. Upon cooling and solidification, the solid silver/silver chloride electrode was compared with a standard calomel electrode and was found to provide a constant, stable voltage. The reference electrode and mounting means developed for use in this invention is illustrated in FIG. 4.

The reference electrode assembly 60 is inserted into the cell via passage 50 which is provided with standard pipe threading. The assembly 60 is comprised of the reference electrode 62 comprising the aforementioned silver/silver chloride, a lower support mounting 64, a compressible sealing member 66, and an upper support mounting 68. The lower support mounting 64 is generally cylindrical in shape and has a passage 70 therethrough. The exterior of mounting 64 is provided with outwardly extending threads 72 such that a sealing engagement can be created between the passage 50 and mounting 64 upon insertion of the mounting therein, and tightening in the usual manner. At least an upper portion 74 of passage 70 through mounting 64 is conical in shape and tappers such that the diameter of the passage at its entrance is greater than the diameter of the passage at its exit from mounting 64. The reference electrode 62 is inserted through the passage 70 to extend within the cell upon inserting lower support mounting 64 into passage 50. The compressible sealing material 66 is placed around the reference electrode 62. It will be noted that the sealing member 66 extends above the conical portion 74 of passage 70 so that compression of the sealing member 66 into sealing engagement with the reference electrode 62 can be effected. The upper portion of mounting 64 is also provided with a plurality of external threads 76 to effect sealing engagement with the upper support mounting 68.

The upper support mounting 68 is generally cylindrical in shape and is provided with a passage 78 having a diameter at a lower portion 80 greater than its diameter at an upper portion 82. The interior wall of upper support mounting 68 which forms the lower portion 80 of passage 78 is provided with upwardly extending threads 84 of a size complimentary to that of the exterior threads 76 of lower support mounting 64 such that a sealing engagement is created upon joining the mountings together and tightening in the usual manner. The diameter of the upper portion 82 of passage 78 is slightly greater than the diameter of the electrode 62 such that the electrode is capable of passing through the passageway.

The upper support mounting 68 is placed over the reference electrode 62 and fixedly secured to the lower support mounting 64 through sealing engagement of the threaded portions thereof. The action of sealing the upper and lower support mountings together via the threaded portions 76 and 84 provides the additional effect of compressing the sealing member 66 about the reference electrode 62 to securely position the electrode within the assembly 60.

In an alternate embodiment, the reference electrode is passed through the passage 78 in the upper support mounting 68 prior to the electrodes insertion into the lower support mounting 64 and addition of the compressible sealing member 66. The upper support mounting then is positioned as if it had been placed over the reference electrode 62 and the assemblage is conducted as previously described.

The reference electrode, the anodes 26 and the cathodes 24 are connected by suitable electrical connections to a potential monitoring and adjustable voltage electrodal power source such as a potentiostat. The potentiostat provides a means by which a desired potential between the anodes 26 and reference electrode 62 can be preset. The potentiostat then will monitor the potential between the reference electrode 62 and the anodes 26 while automatically adjusting the applied voltage to the anodes 26 and cathodes 24 to obtain and maintain that preset potential.

The electrolytic cell of this invention is well adapted for use in continuous electrochemical process wherein an anolyte and catholyte are introduced into respective cell compartments into contact with the anodes and cathodes contained therein until the reaction has proceeded to a desired degree, whereupon the anolyte and catholyte are removed from the cell. The removed electrolytes can be passed to additional external processing equipment and recovered, recirculated to the same cell, or to an adjacent cell for further electrochemical treatment, if desired. The present cell also may be used in a batch process in which the electrolytes are circulated in the cell until the desired electrochemical reaction is complete.

In operation, anolyte comprising WPA is introduced into the cell via entrance ports 28 to fill the anode compartments created by the ion exchange membranes 22 and catholyte comprising raffinate is introducted into the cell via entrance ports 32 to fill the cathode compartments. The temperature level of the anolyte and catholyte within the cell is maintained in the range of from about 15 degrees C. to about 95 degrees C. and preferably in the range of from about 40 degrees C. to about 65 degrees C.

The reference potential voltage then is preset in the potentiostat and voltage is applied to the electrolytic circuit. As previously mentioned, the reference potential voltage is preset in the range of from about +1200 to about +1600 millivolts and preferably in the range from about +1350 to about +1450 millivolts as referenced to the silver/silver chloride reference electrode of this invention.

It has been found that the average residence time required to substantially oxidize all of the vanadium and uranium present in the WPA to their more recoverable valence forms is less than 5 minutes when using the high surface area anodes and cathodes of this invention. That is, when using anodes having an anode surface area to anolyte ratio of in excess of 25 $ft^2$/gal, the average residence time necessary to oxidize the vanadium and uranium present in the anolyte is less than 5 minutes.

Thus, in a continuous process, the flow rate of the anolyte can be adjusted such that the necessary residence time can be achieved by operating at a sufficiently low flow rate, by recycling anolyte within a single cell or by arranging a series of cells through which the anolyte will pass to oxidize the solution by for example gravity cascade from one cell to the next. Further, a number of cells could be arranged in a parallel system to increase the process throughout or in a combination of parallel and series arrangement.

Preferably, the catholyte flow rate is adjusted such that it is the same as the anolyte flow rate, however this is not necessary to the successful operation of the process.

While the present invention has been described in what is considered to be the preferred embodiment thereof, it is to be understood that changes and modifications in the process and apparatus can be made without departing from the spirit or scope of this invention as defined in the following claims.

What is claimed is:

1. An electrolytic cell for controlled potential electrolysis adapted to contain an anolyte and a catholyte which comprises:
   - a tank having a closed bottom and an open top;
   - a plurality of high surface area anodes disposed in said tank and secured to said tank in spaced apart, substantially parallel relationship with respect to one another;
   - a plurality of vertically positioned, substantially parallel, high surface area cathodes disposed and secured in said tank and said cathodes being spaced apart to receive an anode between each adjacent pair of cathodes;
   - a plurality of vertically positioned, substantially parallel, ion exchange membranes disposed in said tank, said ion exchange membranes being spaced apart to receive alternately anodes and cathodes between each adjacent pair of ion exchange membranes to thereby form separate compartments;
   - a reference electrode disposed in said tank to provide a potential voltage measurement within a compartment;
   - said cell being provided with inlet means for introducing anolyte and catholyte into the separate compartments containing anodes and cathodes respectively and exit means for removing said anolyte and catholyte therefrom.

2. The electrolytic cell of claim 1 defined further as a tank having a removable top.

3. The electrolytic cell of claim 1 defined further as a tank comprising a non-electrically conductive, non-corrosive material.

4. The electrolytic cell of claim 1 in which said reference electrode consists essentially of crystallized silver chloride that has been heated to the melting point and formed about a silver substrate to form a silver/silver chloride electrode.

5. The electrolytic cell of claim 1 in which said anodes are defined as having a ratio of anode surface area to anolyte in excess of 20 square feet per gallon of anolyte.

6. The electrolytic cell of claim 1 in which said cathodes are defined as having a ratio of cathode surface area to catholyte in excess of 20 square feet per gallon of catholyte.

7. A process for the controlled potential oxidation of a metal contaminant in an acid solution comprising:

providing an anolyte comprising the acid solution having a reference electrode and an anode therein;

providing a catholyte having a cathode therein;

separating the anolyte and the catholyte by an ion exchange membrane which contacts the anolyte and catholyte on opposing surfaces;

providing an adjustable voltage electrical power source;

connecting the power source to the anode and cathode;

providing a potential monitoring means adapted to measure a potential between the reference electrode and the anode;

continuously monitoring the potential between the reference electrode and the anode; and applying a voltage to the anode from the electrical power source, said voltage being sufficient to maintain a predetermined potential between the reference electrode and the anode whereby the metal contaminant in the acid solution is oxidized.

8. A process as set forth in claim 7 wherein the acid solution comprises wet process phosphoric acid and the metal contaminant is selected from the group consisting of vanadium and uranium.

9. A process as set forth in claim 8 wherein the predetermined potential is maintained within a range of from about +1200 to about +1600 millivolts with respect to the reference electrode.

10. A process as set forth in claim 8 wherein the anode comprises a metal substrate selected from the group consisting of titanium, zirconium, tantalum, niobium, hafnium and alloys thereof which has been coated with a nobel metal selected from the group consisting of platinum, iridium, ruthenium and alloys thereof.

* * * * *